US007086429B2

(12) United States Patent
Moizumi

(10) Patent No.: US 7,086,429 B2
(45) Date of Patent: Aug. 8, 2006

(54) INNER BAG FOR TRANSPORT TANK AND LOADING METHOD THEREOF

(75) Inventor: Yoshitsugu Moizumi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/043,960

(22) Filed: Jan. 28, 2005

(65) Prior Publication Data

US 2005/0166994 A1 Aug. 4, 2005

(30) Foreign Application Priority Data

Jan. 30, 2004 (JP) ..... 2004-024189
Mar. 8, 2004 (JP) ..... 2004-064596

(51) Int. Cl.
*B65B 1/04* (2006.01)

(52) U.S. Cl. ..... 141/114; 220/495.05; 383/88

(58) Field of Classification Search ..... 141/10, 141/114, 313–319; 53/445, 449; 383/88–91; 220/23.9, 495.01, 495.05, 495.06
See application file for complete search history.

(56) References Cited

U.S. PATENT DOCUMENTS 3,068,561 A * 12/1962 Jones ..... 29/401.1
4,256,150 A * 3/1981 Mockesch ..... 141/5
5,794,670 A * 8/1998 LaFleur ..... 141/314
6,286,700 B1 * 9/2001 Davidson ..... 220/1.6

FOREIGN PATENT DOCUMENTS

| | | |
|---|---|---|
| JP | 50-4615 | 1/1975 |
| JP | 57-46492 U | 3/1982 |
| JP | 61-48190 U | 3/1986 |
| JP | 61-104983 A | 5/1986 |
| JP | 2001-354292 A | 12/2001 |

* cited by examiner

*Primary Examiner*—Steven O. Douglas
(74) *Attorney, Agent, or Firm*—Birch, Stewart, Kolasch & Birch, LLP

(57) ABSTRACT

A positioning mark and a display mark are formed in an inner bag body. An inner bag supply-discharge opening is inserted into a tank supply-discharge opening as the positioning mark conforms to a central line extending in the longitudinal direction of the tank body. A bending line in one end portion that is close to the inner bag supply-discharge opening is set above the display mark. Sine the folding line is away from the inner bag supply-discharge opening, the end portion close to the inner bag supply-discharge opening is not filled with liquid in the early stages of the liquid filling, so that the damage of the inner bag and the filling failure can be eliminated.

11 Claims, 14 Drawing Sheets

INNER BAG FOR TRANSPORT TANK AND LOADING METHOD THEREOF

BACKGROUND OF THE INVENTION

1. Field of the Invention

The present invention relates to an inner bag for a transport tank and the loading method thereof.

2. Description of the Prior Arts

In cargo transportation by sea, railroad, road and so forth, a tank container is generally used for liquid materials (cargo). As the tank container, a 20 foot container (hereinafter referred to as a tank container) which conforms to the ISO Standards is ordinarily used, for example. The tank container has 20 foot length, 8 foot width, and 8 foot height, so that about 20 tons of liquid can be filled therein.

In the container transportation to use this kind of tank container, it is necessary to wash the inside of the tank after transportation, and in addition, to produce the tank by using a high quality stainless steel plate with chemical resistance. In order to solve the problems, Japanese Patent Laid-Open Publication No. S61-104983 discloses that an inner bag or liner bag made of soft synthetic resin to have the chemical resistance is loaded in the tank produced from the general steel plate. In addition, Japanese Patent Laid-Open Publication No. 2001-354292, Japanese Utility-Model Laid-Open Publication No. S61-48190, Japanese Patent Laid-Open Publication No. S50-4615, and Japanese Utility-Model Laid-Open Publication No. S57-46492 also disclose to load the inner bag in the tank in order to save the trouble for washing the inside of the tank.

However, with respect to the prior art inner bag to be used in the tanks and tank containers, it is so difficult to produce appropriate inner bags for large tanks including the 20 foot container that there has no practical application. Namely, it has been difficult to produce the inner bag fitting in the cylindrical 20 foot container easily and affordably. The ideal inner bag to fit within the tank container properly would be a cylindrical-shaped inner bag having approximately the same shape as the tank container. However, it is necessary to prepare circular lid films, and in addition, to weld the circular lid films on both ends of a tubular film. To make matters worse, since the circular lid film has to be welded not in a two-dimensional direction, but in a three-dimensional direction, the exclusive guide apparatus for welding the circular lid film is required.

In contrast, an envelope type inner bag is easily produced only by welding the both ends of the tubular film. This type of inner bag prevents the liquid from directly contacting with the inside of the tank by joining supply-discharge openings of the inner bag and the tank. Therefore, changing the inner bag makes it unnecessary to wash the inside of the tank. However, since the tank container is cylindrical, if the envelope type inner bag is loaded therein, the following problem occurs due to the difference in shape between them. If the envelope type inner bag has a capacity equivalent to or larger than that of the cylindrical tank container, the length should be made longer than the tank container. Accordingly, as shown in FIG. 14A for example, when an inner bag 2 is loaded in a tank body 3, an end portion 2*a* of the inner bag 2 incurves in the tank body 3. If liquid 6 is filled from a tank supply-discharge opening 5 in this state, since the tank supply-discharge opening 5 is formed in one end of a lower part of the tank 3, a bending line 2*c* of the end portion 2*a* is located adjacent to the tank supply-discharge opening 5. Thereby, as shown in FIG. 14B, the liquid 6 fills the end portion 2*a* preferentially, the tank supply-discharge opening 5 is plugged due to the weight of the liquid in the end portion 2*a*, so that the further filling of the liquid becomes impossible. Note that an element 7 is an inner bag suction preventing member. The inner bag suction preventing member 7 prevents the inner bag 2 from being sucked into the tank supply-discharge opening 5 in the final stage of discharging the liquid 6 to plug the tank supply-discharge opening 5.

SUMMARY OF THE INVENTION

An object of the present invention is to provide an envelope type inner bag for a transport tank in which liquid is filled smoothly even if an envelope type inner bag is used, and the loading method thereof.

In order to achieve the above object, in a loading method of an inner bag for a transport tank of the present invention, the transport tank has a work hatch and a first supply-discharge opening, while the inner bag with an envelope shape has a second supply-discharge opening to be fitted to the first supply-discharge opening. An inner bag body of the inner bag is folded inward or rolled toward the second supply-discharge opening from both ends of the inner bag body in parallel with a central line extending in a width direction of the inner bag body after both side edges of the inner bag body are folded inward an appropriate number of times in parallel with a central line extending in a longitudinal direction of the inner bag body in a state that the second supply-discharge opening is directed downward. The folded inner bag body is inserted into the transport tank from the work hatch. The folded inner bag body is unfolded in the longitudinal direction in the transport tank after the second supply-discharge opening is inserted into the first supply-discharge opening in the transport tank.

According to the preferred embodiment of the present invention, a first mark is formed to conform an orientation of the inner bag body to that of the transport tank. The second supply-discharge opening is inserted into the first supply-discharge opening in a state that the orientation of the inner bag body to that of the transport tank in reference to the first mark. A longitudinal end portion of the inner bag body adjacent to the second supply-discharge opening is bent toward the second supply-discharge opening after the folded inner bag body is unfolded in the longitudinal direction in the transport tank. The bending position is separated by at least 30 mm from an edge of the first supply-discharge opening, and represented by a second mark which is formed in the inner bag body or the transport tank. The longitudinal end portion of the inner bag body is bent in reference to the second mark.

Furthermore, according to the preferred embodiment of the present invention, the second supply-discharge opening is provided on or adjacent to a central line extending in the longitudinal direction of the inner bag body. When length from one end of the inner bag body to the second supply-discharge opening is L1, length of the inner bag body is IL, width of the inner bag body is IW, an inner peripheral length of the transport tank in a longitudinal cross-sectional surface in the longitudinal direction is TLt, and the inner peripheral length of the transport tank in the longitudinal cross-sectional surface in a width direction is TLr, IL, IW and L1 satisfy the following conditions: $0.49 \cdot TLt \leqq IL \leqq 0.55 \cdot TLt$, $0.49 \cdot TLr \leqq IW \leqq 0.58 \cdot TLr$, and $0.44 \cdot IW \leqq L1 \leqq 0.50 \cdot IW$.

Moreover, according to the another embodiment of the present invention, the inner bag body is loaded in the transport tank after the inner bag body is attached temporally to an inner surface of the transport tank by a fixing member provided in the inner bag body or the transport tank.

According to the present invention, when the end portion of the inner bag body located adjacent to the second supply-discharge opening is bent to the first supply-discharge opening side after loading the inner bag body into the transport tank, the position of the bending line is separated by at least 30 mm from the second supply-discharge opening, so that the liquid is not filled in the end portion of the inner bag body in the first supply-discharge opening side even if the liquid filling is started through the first supply-discharge opening. Therefore, the liquid is filled in the end portion of the inner bag body located far from the first supply-discharge opening. Consequently, it is possible to fill the liquid smoothly without plugging the first supply-discharge opening plugged by the weight of the liquid which has been already filled in the end portion of the inner bag body in the first supply-discharge opening side.

In addition, the position of the bending line can be confirmed by providing the display mark for representing the position of the bending line in the inner bag body or the transport tank, so that it is possible to load the inner bag body in the transport tank surely. Moreover, the inner bag can be fixed in a position where the inner bag body is unfolded smoothly by using a fixing member for temporally fixing the inner bag body to the inner peripheral surface of the transport tank when loading the inner bag body in the transport tank. Thereby, the end portion or others of the inner bag body is not sandwiched between the inner wall of the transport tank and the portion in which the liquid is filled in the inner bag body due to the weight of the liquid, so that the liquid can be filled smoothly.

Furthermore, since the orientation of the transport tank conforms to that of the inner bag body in reference to the positioning mark formed in the inner bag body, the inner bag body is not loaded diagonally to the transport tank, so that it is possible to prevent the damage of the inner bag body caused by the extra weight added to the inner bag body when the inner bag body is slid to one side of the transport tank in transporting the tank, and to prevent the insufficient filling of the liquid.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
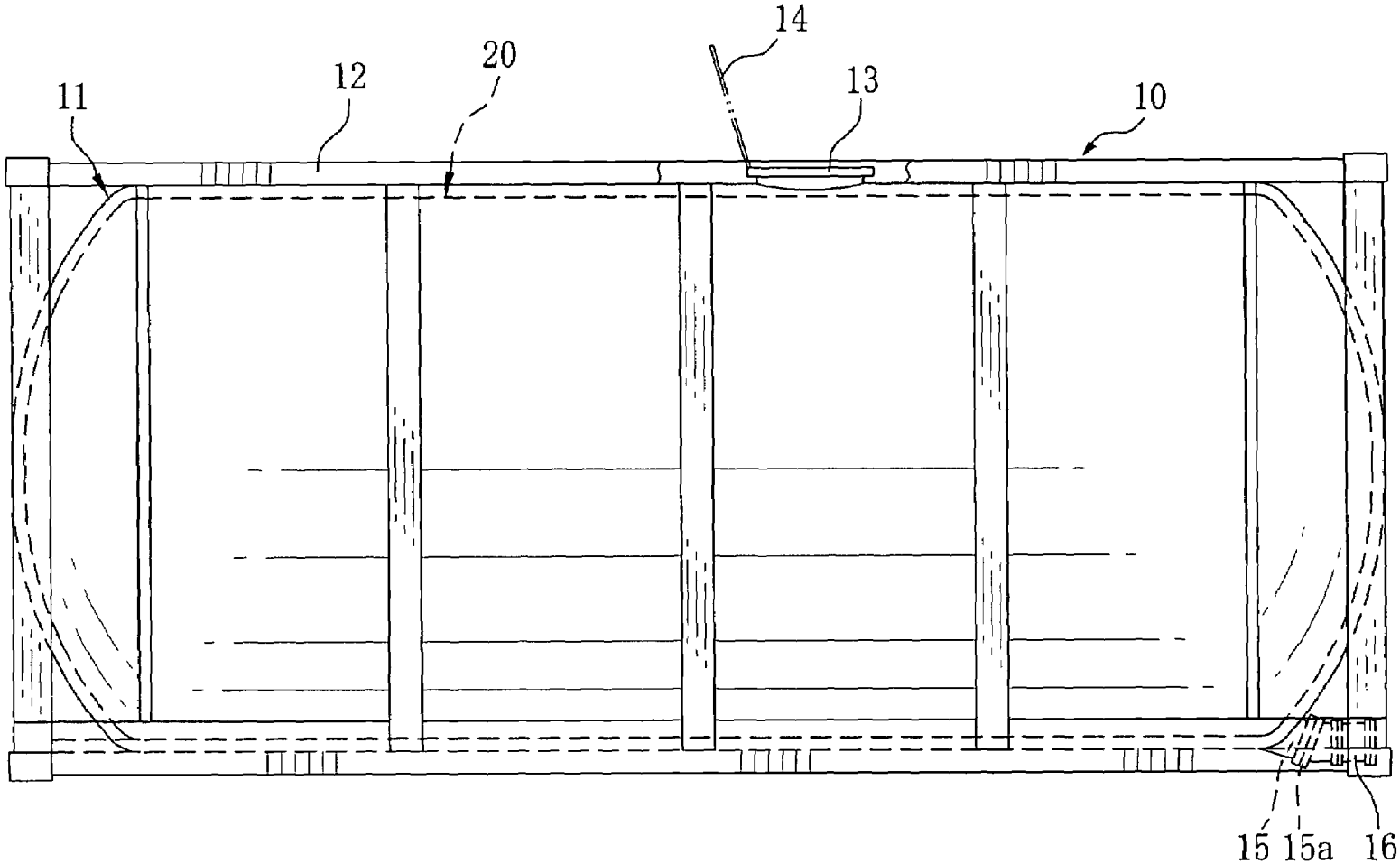
FIG. 1 is a front view of a tank container in which an inner bag for a transport tank of the present invention is loaded.

In FIG. 1, a twenty-foot ISO container 10 is constituted of a tank body 11 and a rectangular parallelepiped frame 12 for holding the tank body 11. A hatch 13 is formed at the top face of the tank body 11. The maintenance and filling of liquid are performed through the hatch 13. At the time of transporting, a lid 14 is locked by a locking member in order to prevent the lid 14 covering the hatch 13 from opening. A tank supply-discharge opening 15 is formed in one end of a lower portion of the tank body 11. A foot valve 16 is fixed through a flange 15*a* of the tank supply-discharge opening 15.

An inner bag for a transport tank (hereinafter referred to as an inner bag) 20 is loaded into the tank body 11. The inner bag 20 is brought into the tank body 11 from the hatch 13 by an operating person to set in the tank body 11. The inner bag 20 upswells in the tank body 11 by pouring the liquid as cargo therein from the tank supply-discharge opening 15 through the foot valve 16, so that the inner bag 20 operates as a lining to the tank body 11.

Figure 2A:
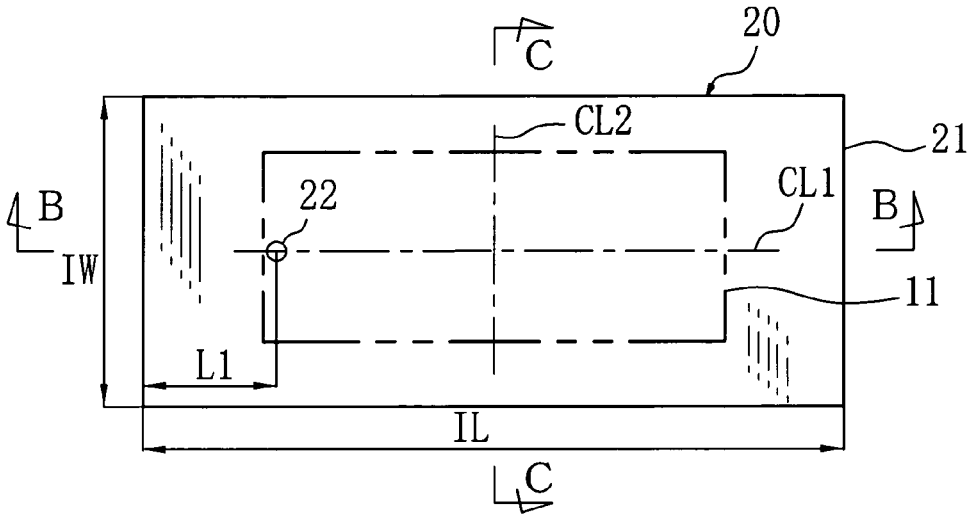
FIG. 2A is an explanatory view of the size of the inner bag fitting in a tank body of the transport tank, wherein a plan view of the tank body and the inner bag is shown.
Figure 3A:
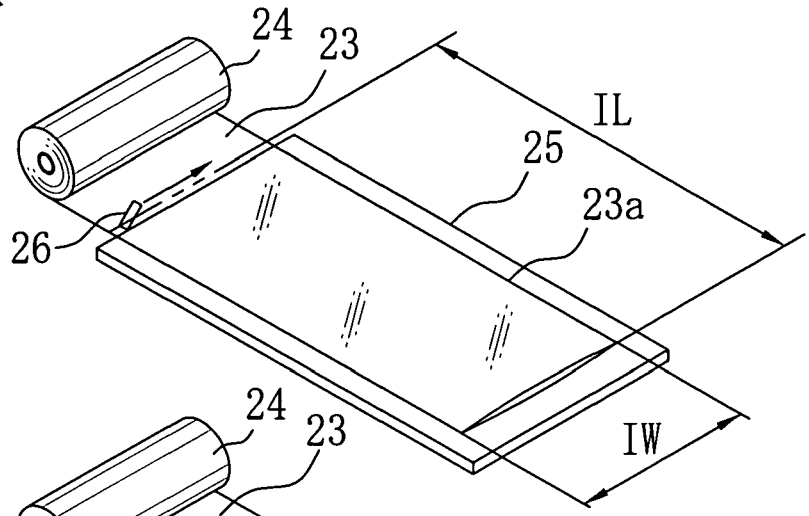
FIGS. 3A, 3B, 3C and 3D are schematic perspective views showing procedure for producing the inner bag.
Figure 3B:
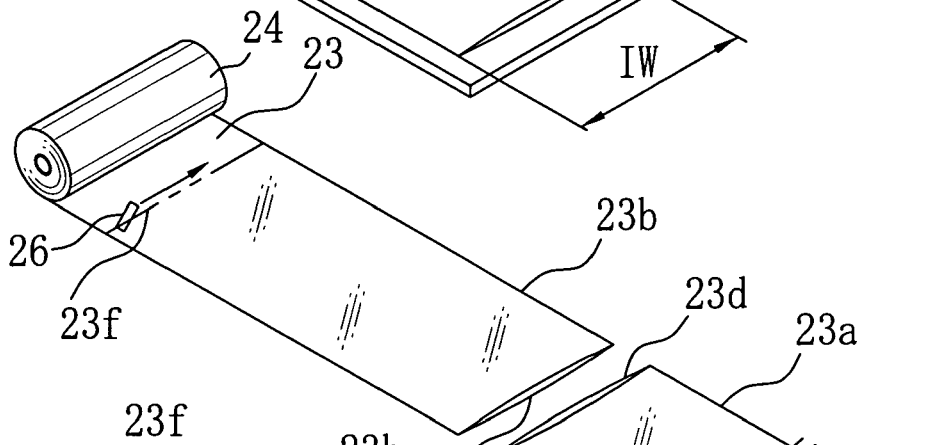

As shown in FIG. 2A, the inner bag 20 is constituted of an inner bag body 21 having an envelope shape and an inner bag supply-discharge opening 22 to be fitted in the tank supply-discharge opening 15. Since the inner bag 20 is formed to the envelope shape, the inner bag body 21 can be easily formed as shown in FIGS. 3A–3D. In FIG. 3B, a tubular film 23 is cut into a predetermined length after being drawn from a film roll 24 which is the roll of the tubular film 23, and then both end portions 23*a* and 23*b* of the tubular film 23 are closed by thermally welding or the like (see FIGS. 7A and 7C).

Figure 2B:
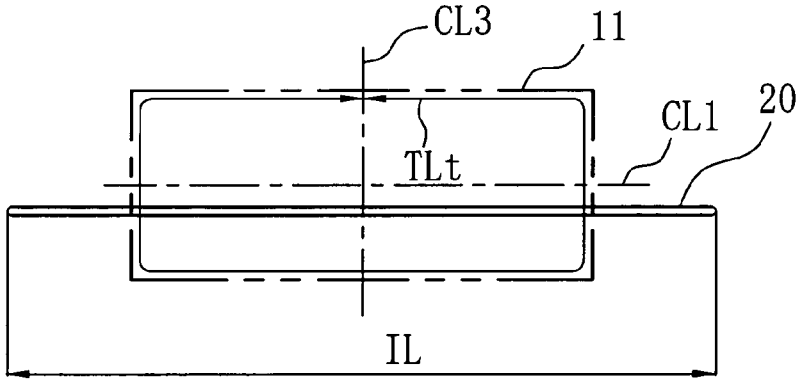
FIG. 2B is an explanatory view of the size of the inner bag fitting in the tank body, wherein a longitudinal cross-sectional surface of the tank body in a longitudinal direction is shown.
Figure 2C:
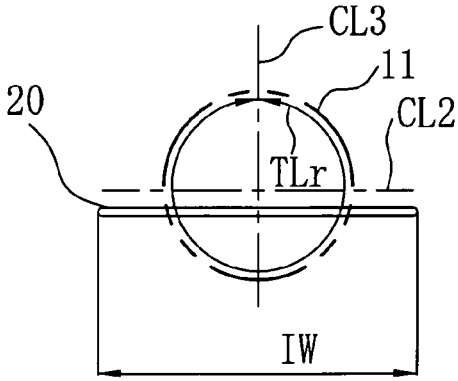
FIG. 2C is an explanatory view of the size of the inner bag fitting in the tank body, wherein a longitudinal cross-sectional surface of the tank body in a width direction is shown.

In FIG. 2A, a longitudinal cross-sectional surface including a central line CL1 extending in the longitudinal direction of the tank body 11 (B—B arrowed cross-section) is referred to as a longitudinal cross-sectional surface in the longitudinal direction, while a longitudinal cross-sectional surface including a central line CL2 extending in the width direction of the tank body 11 (C—C arrowed cross-section) is referred to as a longitudinal cross-sectional surface in the width direction. A line CL3 shown in FIG. 2B is a central line extending in a height direction of the tank body 11.

The tank body 11 is formed to a tubular shape whose both ends are closed to be placed transversally, while the inner bag 20 is formed to the envelope shape. Therefore, if the inner bag 20 is smaller than the appropriate size corresponding to the size of the tank body 11, a predetermined filling capacity is not ensured. To make matters worse, the smaller inner bag creates a gap between the inner peripheral surface of the tank body 11 and the inner bag 20 where the inner bag 20 together with the liquid can move to damage the welded portion of the inner bag supply-discharge opening 22 and the welded lines of the both ends of the inner bag 20. Whereas, if the inner bag 20 is larger than the appropriate size corresponding to the size of the tank body 11, the raw material of the inner bag 20 is wasted. Moreover, if an extra portion such as the end portion of the inner bag 20 is under the liquid filled in the inner bag 20, the extra portion is sandwiched between the inner bag body 21 filled with the liquid and the peripheral surface of the tank body 11 due to the weight of the liquid. As a result, it becomes impossible to fill liquid furthermore. If the liquid is kept filled while the extra portion is sandwiched, the internal pressure of the inner bag 20 rises to possibly damage the inner bag 20.

In the present embodiment, the size of the envelope type inner bag 20 is limited within a specific range based on the size of the tank body 11 for the purpose of preventing the filling failure and the damage of the inner bag 20. When the length of the inner bag 20 is IL, the width thereof is IW, the inner peripheral length (first inner peripheral length) of the tank body 11 in the longitudinal cross-sectional surface in the longitudinal direction is TLt, and the inner peripheral length (second inner peripheral length) of the tank body 11 in the longitudinal cross-sectional surface in the width direction is TLr, the following conditions are satisfied:

$0.47 \cdot TLt \leqq IL \leqq 0.6 \cdot TLt$; and $0.47 \cdot TLr \leqq IW \leqq 0.6 \cdot TLr$.

IL and IW preferably satisfy the following conditions:

$0.49 \cdot TLt \leqq IL \leqq 0.55 \cdot TLt$; and $0.49 \cdot TLr \leqq IW \leqq 0.58 \cdot TLr$.

As above-mentioned, the size of the inner bag 20 is limited based on the inner peripheral length of the tank body 11, so that the tank body 11 may have different shapes than tube such as an elliptical shape or others.

The inner bag supply-discharge opening 22 is provided on the central line extending in the longitudinal direction at a position apart from one end of the inner bag 20 by the distance L1=1750 mm or adjacent thereto. The distance L1 is limited within a range $0.44 \cdot IW \leqq L1 \leqq 0.50 \cdot IW$ based on the width IW of the inner bag 20, so that it is possible to position the central positions in the longitudinal direction of the tank body 11 and the inner bag 20 with each other if the inner bag 20 is attached to the tank body 11 with reference to the tank supply-discharge opening 15, which is formed in the end of the lower portion of the tank body 11. Thereby, the extra portions in both ends of the inner bag 20 can be distributed approximately evenly in the tank body 11. Accordingly, the extra portion of the inner bag 20 dose not build up on one side to be sandwiched between the tank body 11 and the inner bag body 21, so that the filling failure and the damage of the inner bag 20 are eliminated.

Figure 4:
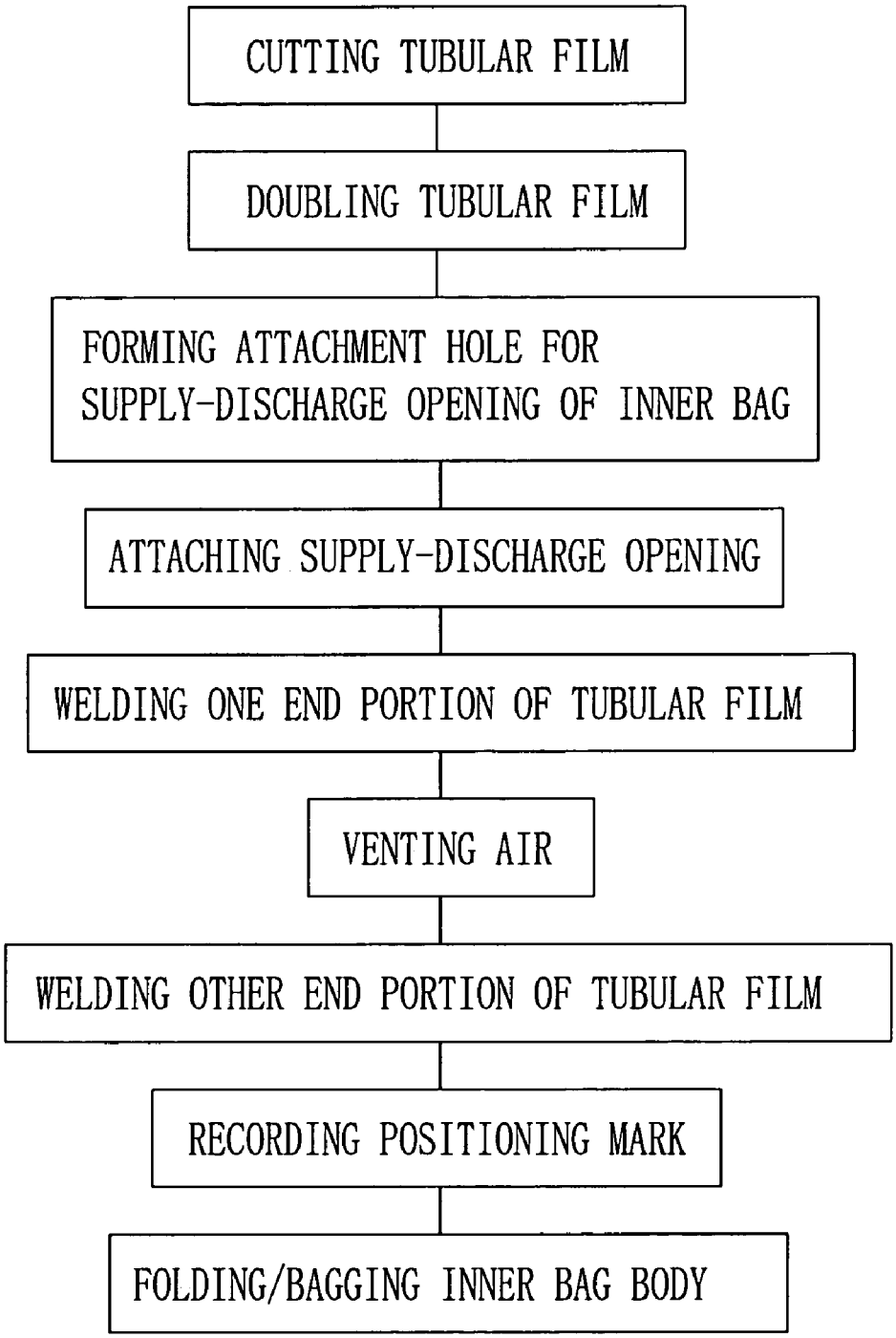
FIG. 4 is a flow chart showing the procedure for producing the inner bag.

Next, the procedure for producing the inner bag 20, which is shown in FIG. 4, is explained. As shown in FIGS. 3A and 3B, the tubular film 23 is drawn from the film roll 24 to be put on a work table 25, and then cut into the length IL by a cutter 26 or the like. The tubular film 23 is made from LLDPE (linear low density polyethylene), and wound into a roll shape to be stored. Since the inner bag 20 is doubled in the present embodiment, it is necessary to form the two tubular films 23 by cutting the tubular film 23 twice into the length IL. The inner bag 20 of the present invention is used for the 20 foot container, so that the first inner peripheral length TLt≈15500 mm, and the second inner peripheral length TLr≈7100 mm, while IL=8300 mm and IW=3900 mm based on the above-mentioned appropriate size range. The thickness of a single layer of the tubular film 23 is 120 μm. Since the tubular film 23 of the present embodiment has two layers, the entire thickness of the tubular film 23 is 240 μm. The thickness of the film is preferably 80–500 μm, especially 100–300 μm.

Figure 3C:
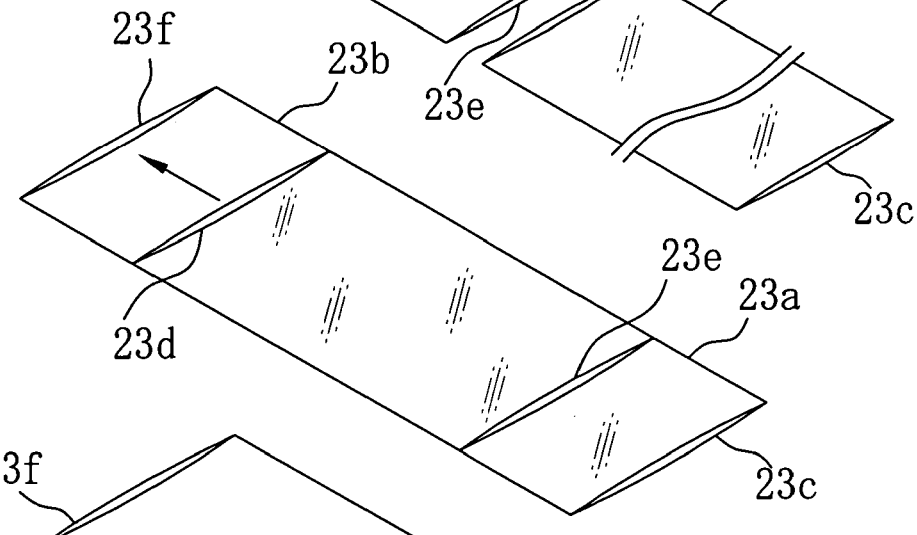
Figure 3D:
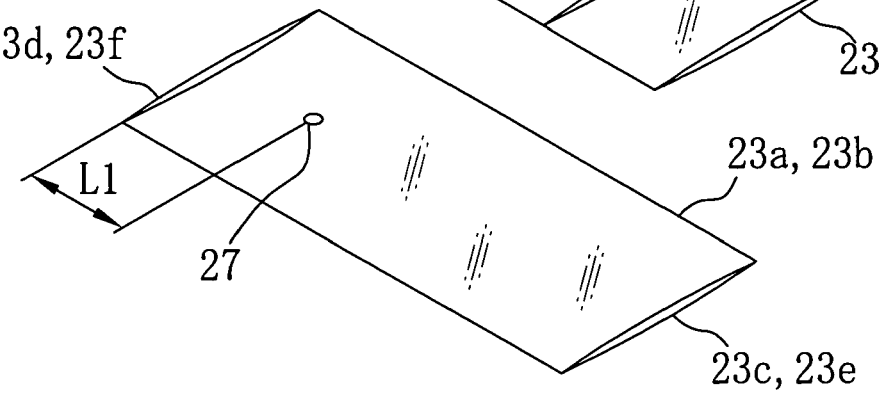

As shown in FIG. 3C, in doubling the tubular films 23*a* and 23*b*, one tubular film 23*a* is inserted into another tubular film 23*b*. Subsequently, as shown in FIG. 3D, a hole 27 corresponding to the inner bag supply-discharge opening 22 is opened on only the upper two layers of films by a punch or a cutter. The inner bag supply-discharge opening 22 is located at the center in the width direction and apart from other end portion 23*d* by the distance L1=1750 mm.

Figure 5:
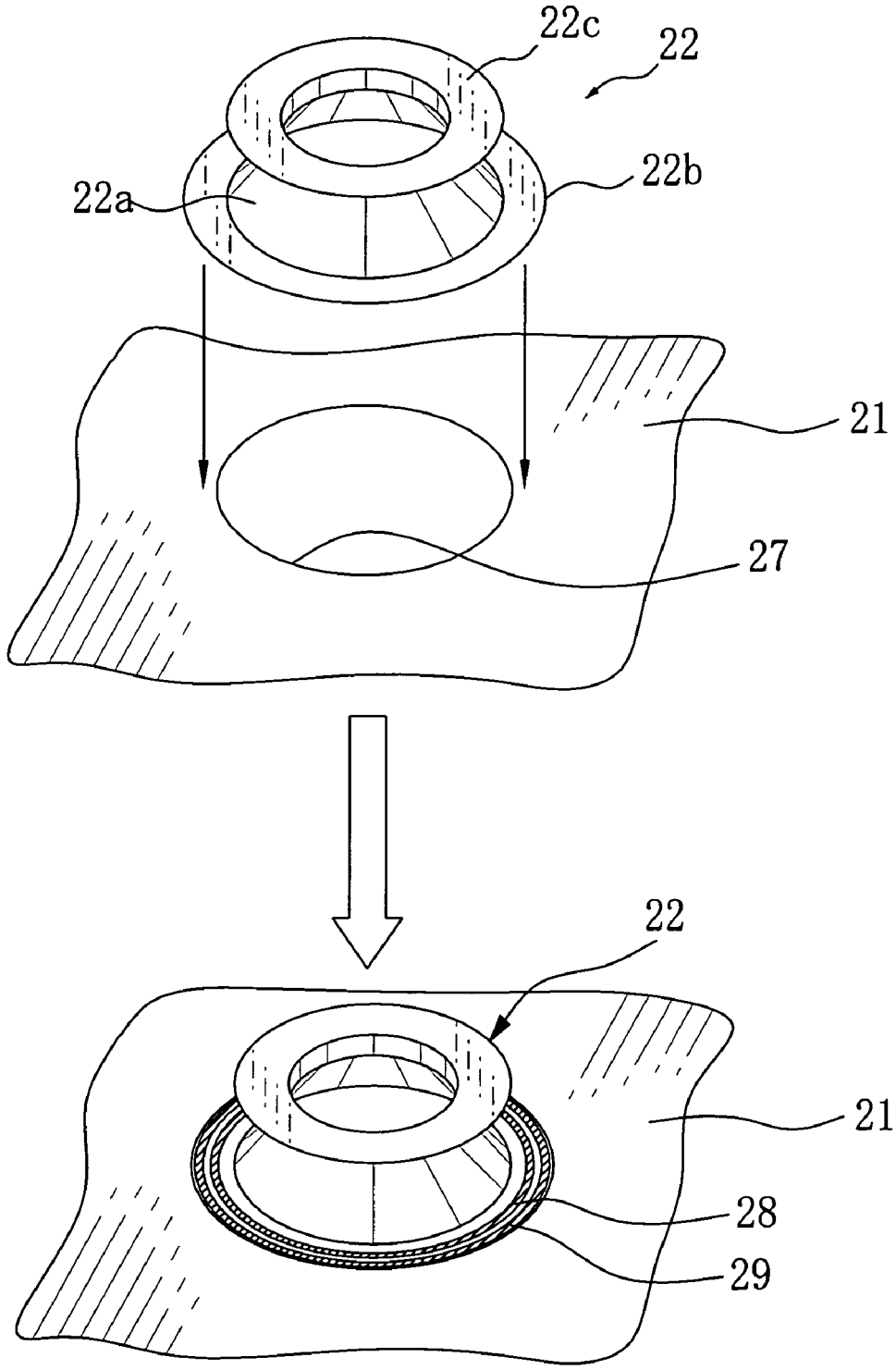
FIG. 5 is an explanatory view showing procedure for welding an inner bag supply-discharge opening.
Figure 6:
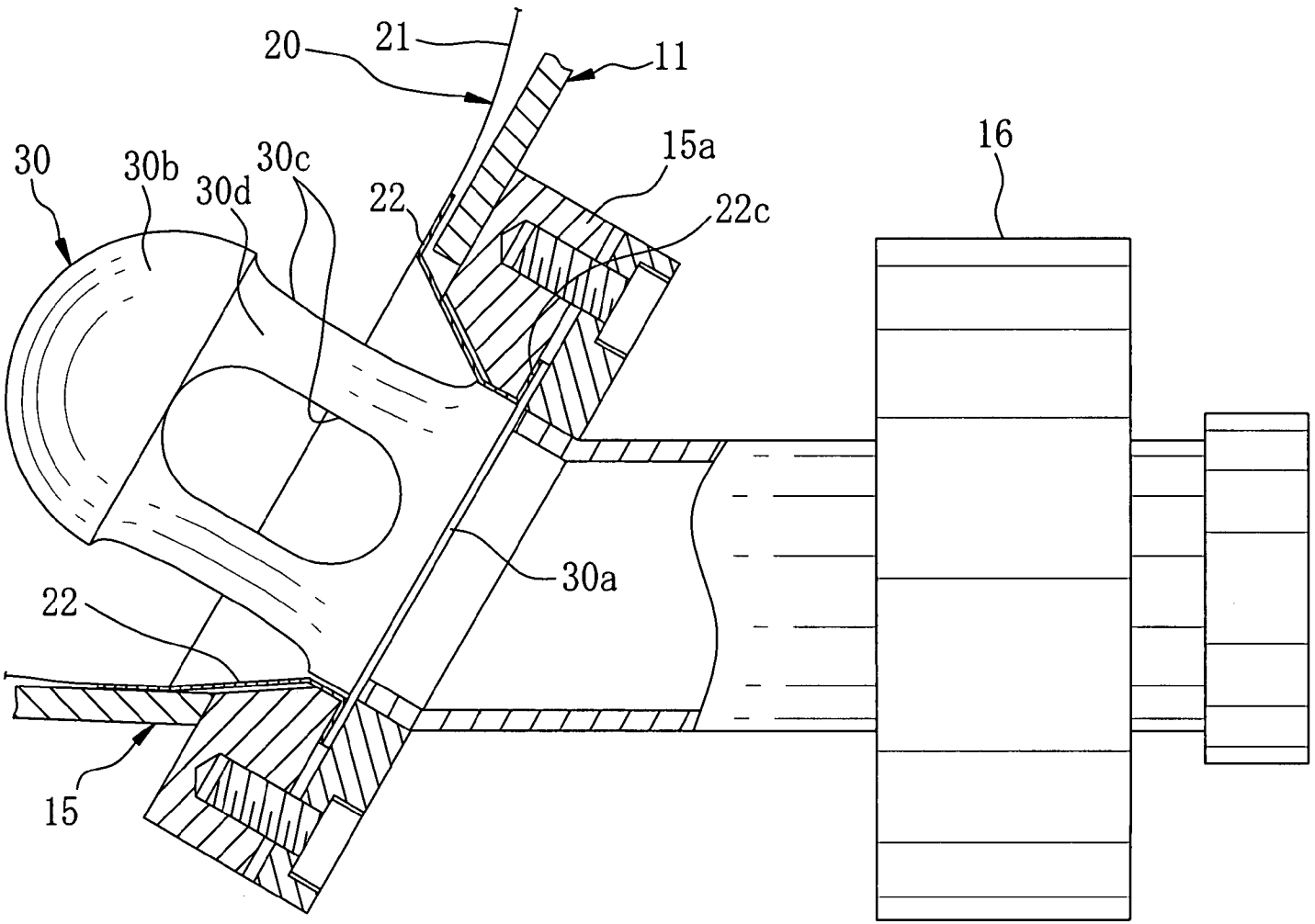
FIG. 6 is a cross-sectional view showing a state where the inner bag supply-discharge opening is attached to a tank supply-discharge opening.

As shown in FIG. 5, when the inner bag supply-discharge opening 22 is attached to the inner bag body 21, the opening 22 is thermally welded to a peripheral edge of the hole 27. At this time, only the upper two layers of the films are thermally welded. The inner bag supply-discharge opening 22 is constituted of a supply-discharge mouth 22*a* having a truncated conical and cylindrical shape, a welding flange 22*b* and an attachment flange 22*c* which are attached to both the ends of the supply-discharge mouth 22*a*, and integrally formed by using LLDPE for example. The welding flange 22*b* and the inner bag body 21 are thermally welded by a thermal welding apparatus (not shown) to form welding lines 28 and 29. As shown in FIG. 6, when the inner bag supply-discharge opening 22 is inserted to the tank supply-discharge opening 15 from the inside of the tank, the attachment flange 22*c* protrudes outside the flange 15*a* of the tank supply-discharge opening 15 to be fixed firmly to the flange 15*a*.

As shown in FIG. 6, a flange 30*a* of an inner bag suction preventing member 30 and the foot valve 16 are attached to the flange 15*a* of the tank supply-discharge opening 15, so that the inner bag supply-discharge opening 22 is attached firmly to the tank supply-discharge opening 15. The supply-discharge mouth 22*a* is formed along the inner peripheral surface of the tank supply-discharge opening 15.

Figure 7A:
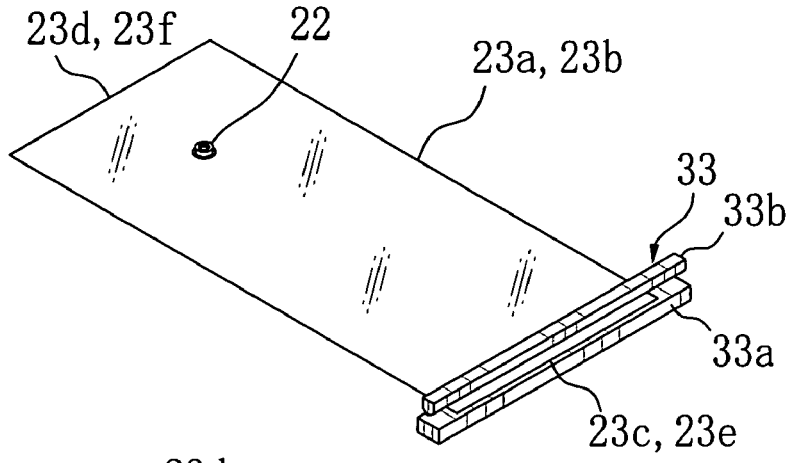
FIG. 7A is a perspective view showing process for welding one end of a tubular film.

As shown in FIG. 7A, in welding the one end portion of the tubular film 23, all four layers of films in the end portions 23*c* and 23*e* of the tubular films 23*a* and 23*b* are thermally welded simultaneously by the thermal welding apparatus 33 to seal the end portions 23*c* and 23*e*. The thermal welding apparatus 33 is constituted of a receiving stage 33*a* and a welding head 33*b*. The heat is applied to the end portions 23*c* and 23*e*, which are held by the welding head 33*b* and the receiving stage 33*a* after the welding head 33*b* has been moved down.

Figure 8A:
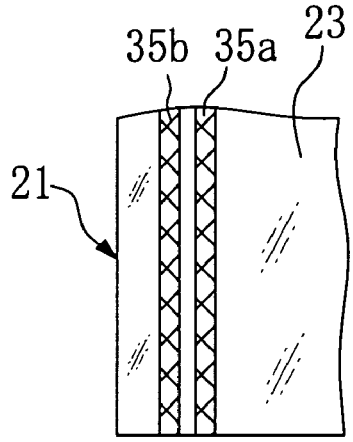
FIG. 8A is an enlarged plan view showing a welding line of the inner bag, wherein the inner and outer tubular films are thermally welded all together into four layer.
Figure 8B:
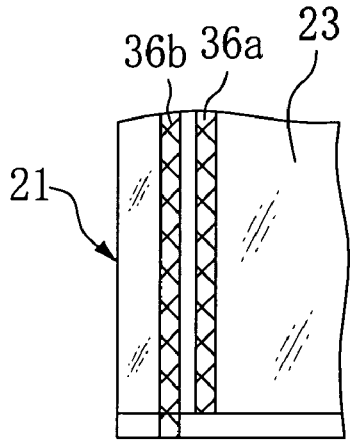
FIG. 8B is an enlarged plan view showing the welding line of the inner bag, wherein the inner and outer tubular films are thermally welded all together into four layer after the end of the inner tubular film have been thermally welded into two layer.
Figure 8C:
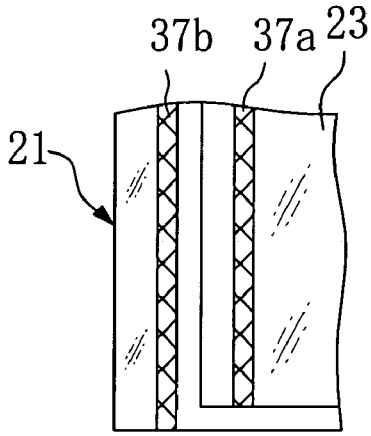
FIG. 8C is an enlarged plan view showing the weld line of the inner bag, wherein the ends of the inner and outer tubular films are thermally welded together into two layer.

As shown FIGS. 8A–C, two stripes of thermal welding lines 35*a* and 35*b* of 5 mm in width are formed linearly at an interval of 5–10 mm. Note that one or three or more thermal welding lines may be formed. In addition, a corrugated thermal welding line may be applied to the present embodiment instead of the linear one. If the plural thermal welding lines are formed, all lines may be formed together, or each line may be formed one by one. In FIG. 8B, a thermal welding line 36*a* is formed by welding the end portion 23*e* of the inner tubular film 23*b*, and then a thermal welding line 36*b* is formed by welding the end portions 23*c* and 23*e* of the outer and inner tubular films 23*a* and 23*b* into four layer at the outer side of the welding line 36*a*. The thermal welding line 36*b* is positioned outside the thermal welding line 36*a*. In FIG. 8C, thermal welding lines 37*a* and 37*b* are formed by welding the end portions 23*c* and 23*e* of the tubular films 23*a* and 23*b* into two layer separately wherein the inner tubular film 23*a* is slightly shorter in length than the outer tubular film 23*b*. Although the thermal welding line may be welded at a time, if the length of the welding head 33*b* is limited, the thermal welding line may be welded sequentially every length of the welding head 33*b*. Note that the end portions of the tubular film 23 may be sealed by ultrasonic welding, other welding method or an adhesive agent, instead of the thermal welding by using the heat-sealing type thermal welding apparatus 33. In addition, the welding and the adhesion may be used together. Moreover, the thermally welding may be performed after a reinforcing film (not shown) has been put on both the side edge portions of the tubular films 23*a* and 23*b* in order to reinforce both the end portions of each welding line.

Figure 7B:
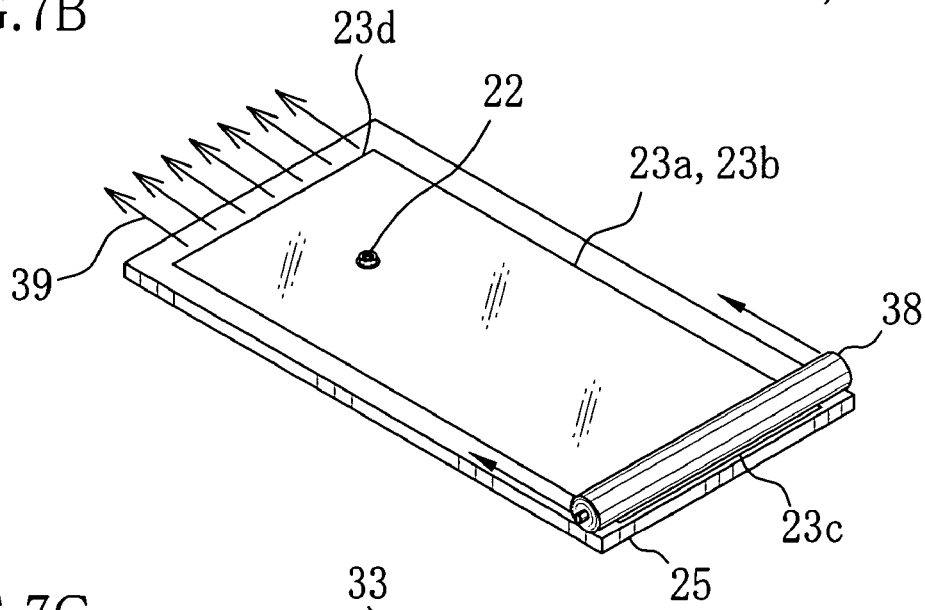
FIG. 7B is a perspective view showing process for venting air from the tubular film.

As shown in FIG. 7B, a pressing roller 38 is rotated on the work table 25 from the welded one end portion 23*c* toward the other end portion 23*d* to vent air 39 in the doubled inner bag body 21. Instead of rotating the pressing roller 38, the air 39 may be vented by folding the inner bag body 21 from one end side to the other end side. Since the inner bag supply-discharge opening 22 is attached close to the other end portion 23*d* so as to protrude from the inner bag body 21, the air between the inner bag supply-discharge opening 22 and the other end portion 23*d* is vented by using a small roller for avoiding the supply-discharge opening 22.

Figure 7C:
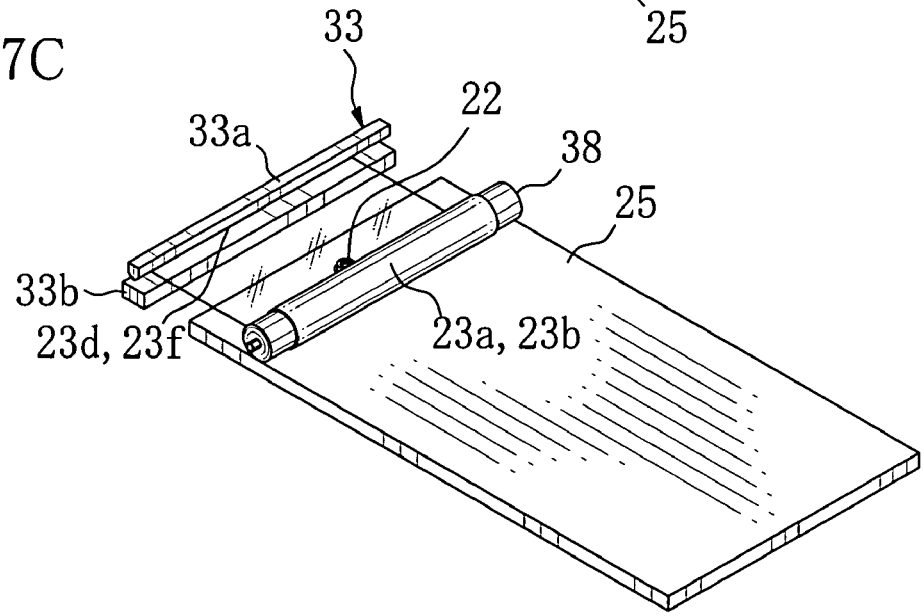
FIG. 7C is a perspective view showing process for welding the other end of the tubular film after the air venting.
Figure 9A:
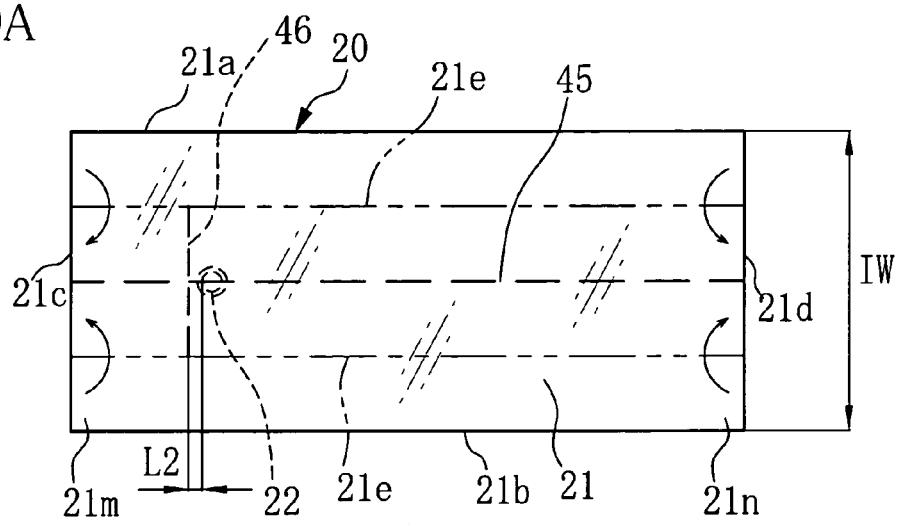
FIGS. 9A, 9B, 9C, 9D and 9E are explanatory views showing process for folding the inner bag to contain it in a packaging bag.

As shown in FIG. 7C, the inner bag 20 shown in FIG. 9A is completed after welding the other end portions 23*d* and 23*f* of the tubular films 23*a* and 23*b* in which the air has been vent by the thermal welding apparatus 33 in the same way as the end portions 23*c* and 23*e*. A straight positioning mark 45 is recorded on the inner bag body 21 along a central line extending in the longitudinal direction of the inner bag body 21 by using an oil-based black ink or the like. Meanwhile, a display mark 46 for representing a limit position of bending an end portion of the inner bag body 21 adjacent to the inner bag supply-discharge opening 22 (hereinafter referred to as a first end portion 21*m*, while another end portion is referred to as a second end portion 21*n*) is recorded on the inner bag body 21, extending in the width direction of the inner bag body 21 by using an oil-based red ink or the like.

Although the display mark 46 is formed away from the inner peripheral edge of the inner bag supply-discharge opening 22 by a distance L2 (L2=100 mm in the present embodiment) and is IW/2 in length, it may be formed to cover the whole length in the width direction. The distance L2 is 30 mm or above, preferably 60 mm or above, particularly 100 mm or above. The liquid can be filled smoothly by bending the first end portion 21*m* above the display mark 46 toward the inner bag supply-discharge opening side, in reference to the display mark 46. If each color of the marks 45 and 46 is changed, these marks can be distinguished certainly.

After completing the inner bag 20, the inner bag body 21 is folded to be contained in the packaging bag 40. The inner bag body 21 is folded in reference to the marks 45 and 46, so that the folding position becomes accurate. Although the marks 45 and 46 are formed linearly in the present embodiment, the shape or size thereof is not limited especially. In addition, the marks 45 and 46 may be written by using the oil-based ink or may be formed by attaching a sticker, instead of printing.

Figure 9B:
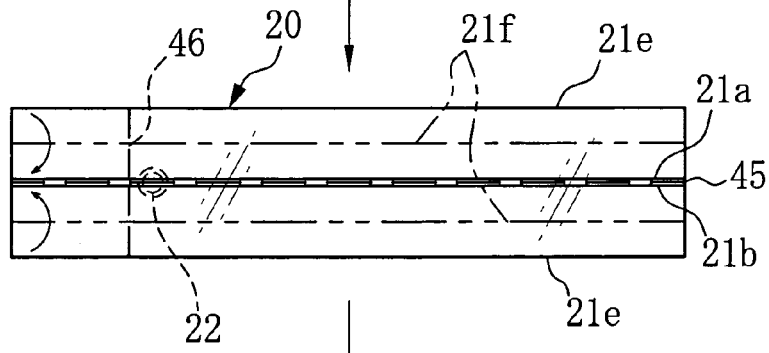
Figure 9C:
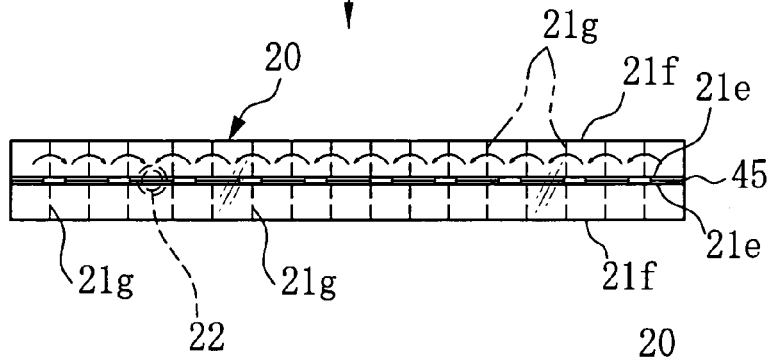
Figure 9D:
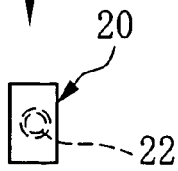
Figure 9E:
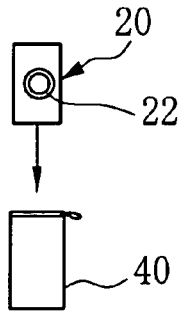

As shown in FIG. 9A, the inner bag body 21 with the supply-discharge opening 22 directed downward is folded inward along inward folding lines 21*e* in parallel with the positioning mark 45 so as to make both the side edge portions 21*a* and 21*b* approach the central line. Likewise, as shown in FIG. 9B, the inward-folded portions are folded inward again along inward folding lines 21*f* in parallel with the central line extending in the longitudinal direction so as to make the inward folding line 21*e* approach the central line. Thereby, the inner bag body 21 is double folded. Subsequently, as shown in FIG. 9C, the inner bag body 21 is folded plural times along the inward folding lines 21*g* toward the inner bag supply-discharge opening 22 from both the end portions 21*c* and 21*d* of the inner bag body 21, so that the inner bag body 21 is folded into a small size as shown in FIG. 9D. The inner bag body 21 may be rewound from the one end to be a roll shape instead of being folded inward along the inward folding lines 21*g*. After folding the inner bag body 21 into the small size, the inner bag 20 is put in the packaging bag 40 as shown in FIG. 9E. Since the inner bag body 21 is double folded along the inward folding lines 21*e* and 21*f*, it can be contained compactly. Note that the inner bag body 21 may be folded once or three times and above along the central line extending in the longitudinal direction.

As aforementioned, since the inner bag body 21 is folded such that the inner bag supply-discharge opening 22 is directed outside the inner bag body 21, the inner bag supply-discharge opening 22 can be inserted to the tank supply-discharge opening 15 easily. In addition, the inner bag body 21 is folded inward along the inward folding lines 21*g*, so that the inner bag body 21 can be expanded easily in the longitudinal direction of the tank body 11 in a state that the inner bag supply-discharge opening 22 is set in the tank supply-discharge opening 15. Furthermore, since the inner bag body 21 is folded inward along each of the inward folding lines 21*e* and 21*f* in a state that the inner bag supply-discharge opening 22 is directed downward, the inner bag body 21 is expanded by itself by filling the liquid from the inner bag supply-discharge opening 22.

Figure 10:
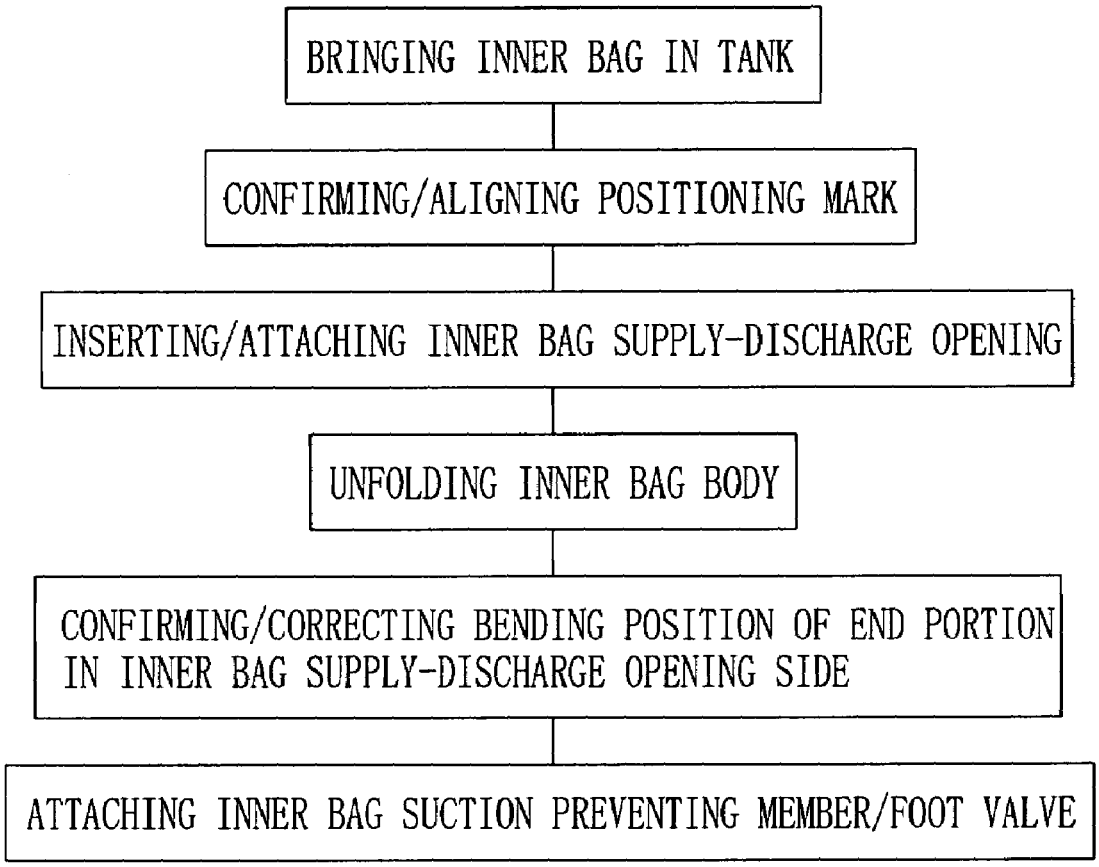
FIG. 10 is a flow chart showing procedure for loading the inner bag in the tank body.

Next, the process of loading the inner bag body 21 in the tank body 11 shown in FIG. 10 is explained. First, the inner bag 20 in the packaging bag 40 is brought into the tank body 11 by the operating person to be taken out of the packaging bag 40. The positioning mark 45 is recorded linearly on the inner bag 20 so as to correspond to the central line CL1 extending in the longitudinal direction of the tank body 11. After the foot valve 16 has been removed from the flange 15*a* of the tank supply-discharge opening 15, the inner bag supply-discharge opening 22 is inserted in the tank supply-discharge opening 15 so as to conform the positioning mark 45 to the central line CL1. Thereby, the attachment flange 22*c* is attached firmly to the flange 15*a*. Second, the inner bag body 21 folded along the inward folding lines 21*g* is unfolded in the longitudinal direction of the tank body 11, and then the folded portions along the inward folding line 21*f* are unfolded.

The inner bag body 21 is attached to the tank body 11 without inclining to the central line CL1 by conforming the positioning mark 45 to the central line CL1 in the longitudinal direction of the tank body 11, so that it is possible to prevent the filling failure caused by the inclined attachment and the damage of the inner bag caused by the extra loading. Although a position aligning mark is preferably formed along the central line CL1 in the tank body 11, it may be omitted. The position aligning mark is written by the ink or formed by stamping, providing a groove or a projection, attaching a seal and so forth.

Figure 11B:
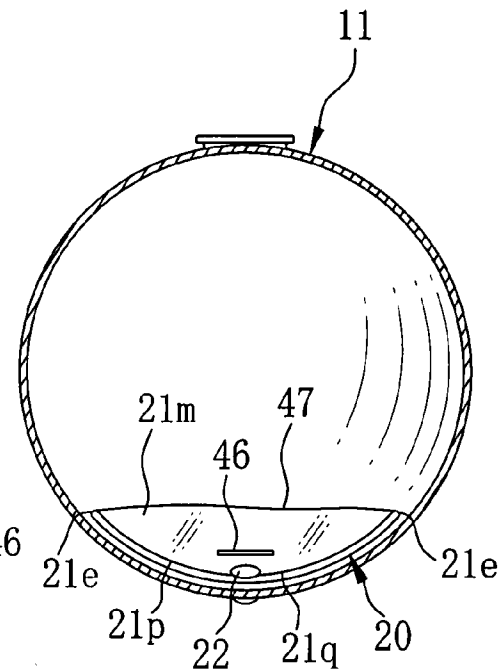
FIG. 11B is a transverse cross-sectional view showing a state where the inner bag is loaded in the tank body.
Figure 11A:
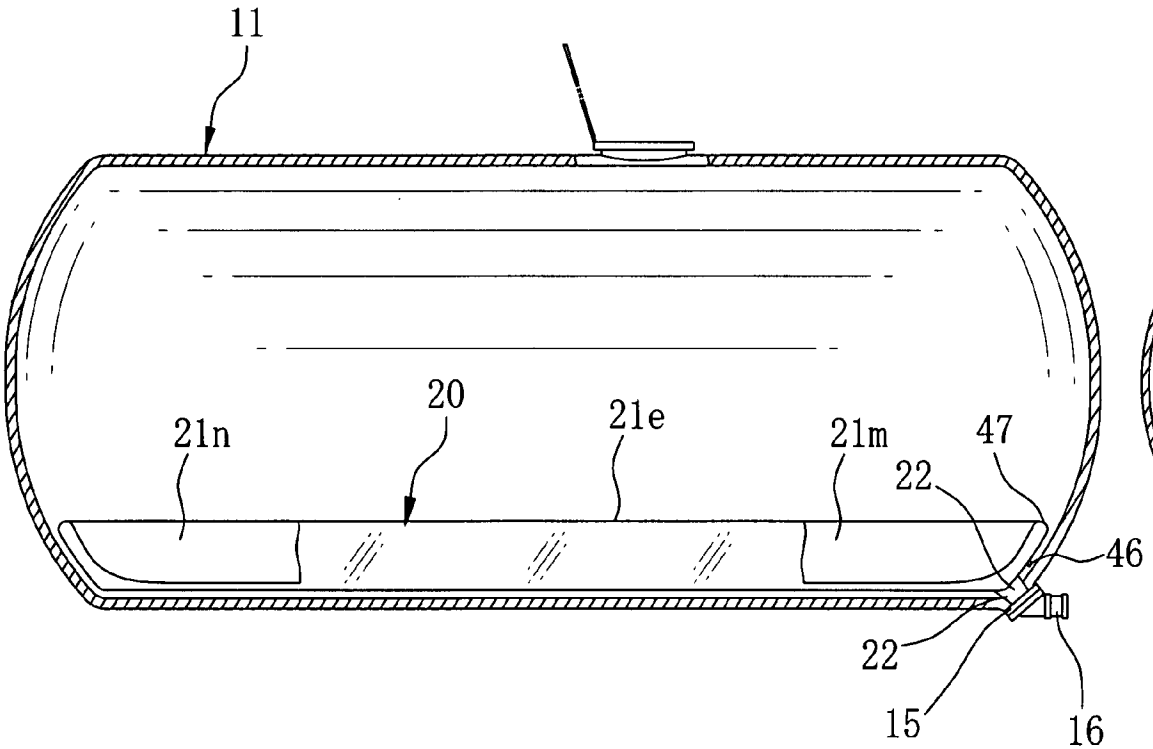
FIG. 11A is a longitudinal cross-sectional view showing a state where the inner bag is loaded in the tank body.
Figure 12A:
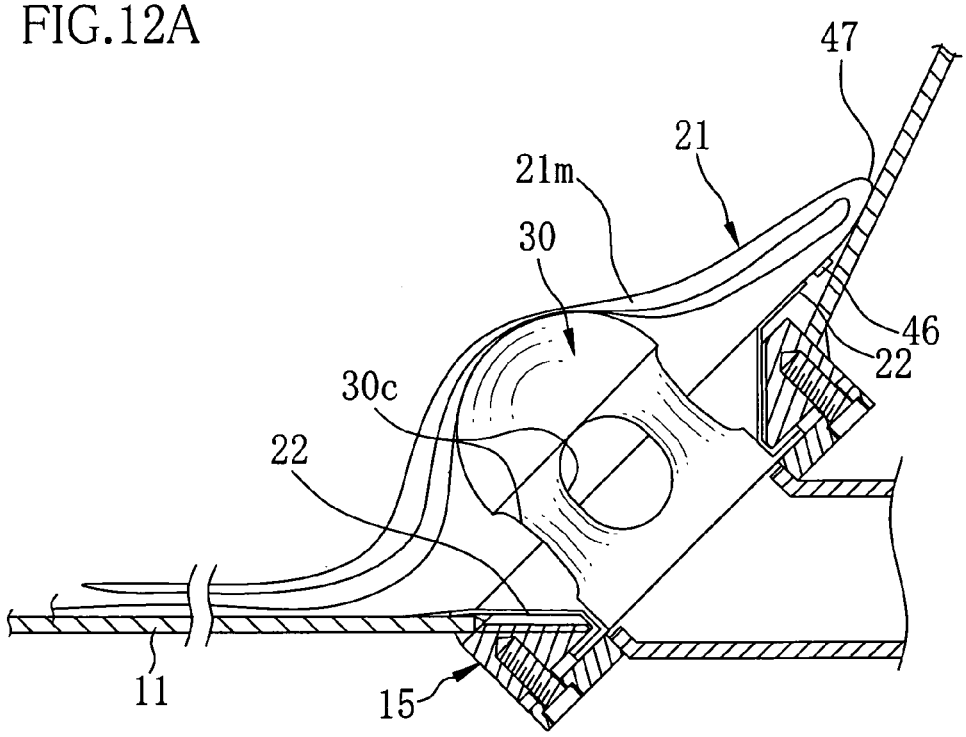
FIG. 12A is a schematic cross-sectional view showing a state where a first end portion is folded above the tank supply-discharge opening in reference to a display mark for representing a position of a bending line before filling liquid in the inner bag.

Next, as shown in FIGS. 11A and 11B and FIG. 12A, the first end portion 21*m* is bent in reference to the display mark 46 so as to locate the actual bending line 47 at a higher position than the display mark 46 to complete the operation for attaching the inner bag body 21 to the tank body 11. As shown in FIG. 11B, both side edge portions 21*p* and 21*q*, which are folded inward along the inward folding lines 21*e*, are not unfolded. Since the approximately overall width of the inside of the tank body 11 is covered by the inner bag body 21 of which both the side edge portions 21*p* and 21*q* are folded along the inward folding lines 21*e*, even if both the side edge portions 21*p* and 21*q* are unfolded, they are folded again by their weight. After unfolding the inner bag body 21 except for both the side edge portions 21*p* and 21*q*, the inner bag suction preventing member 30 and the foot valve 16 are attached to the tank supply-discharge opening 15 from the outside of the tank body 11 as shown in FIG. 6.

Figure 12B:
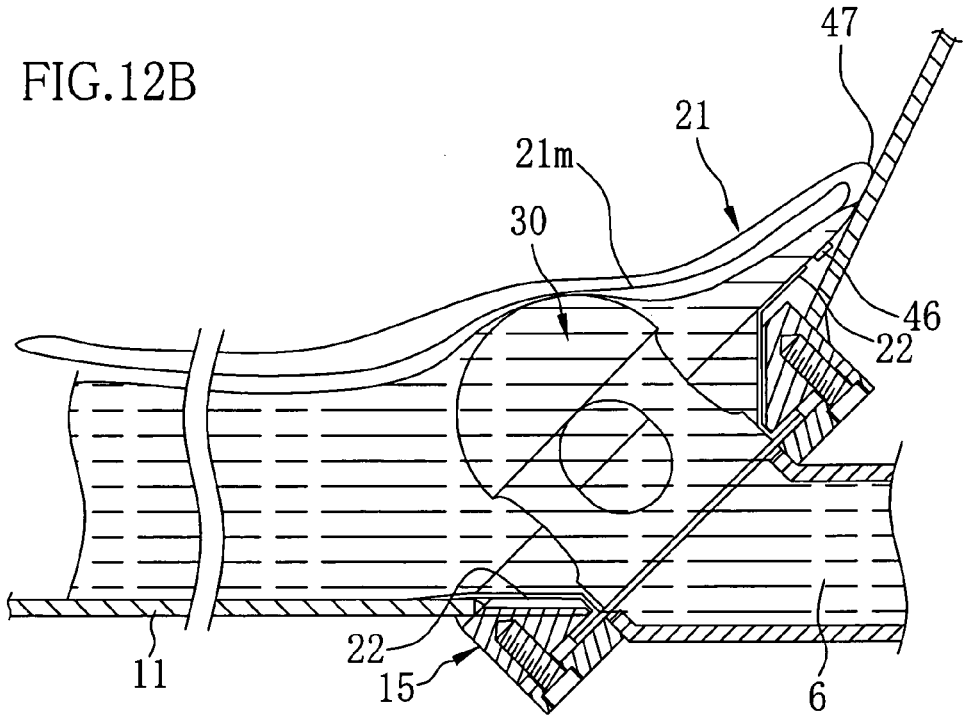
FIG. 12B is a schematic cross-sectional view showing an early stage that the liquid is started to be filled where the first end portion is folded above the tank supply-discharge opening in reference to the display mark.
Figure 14A:
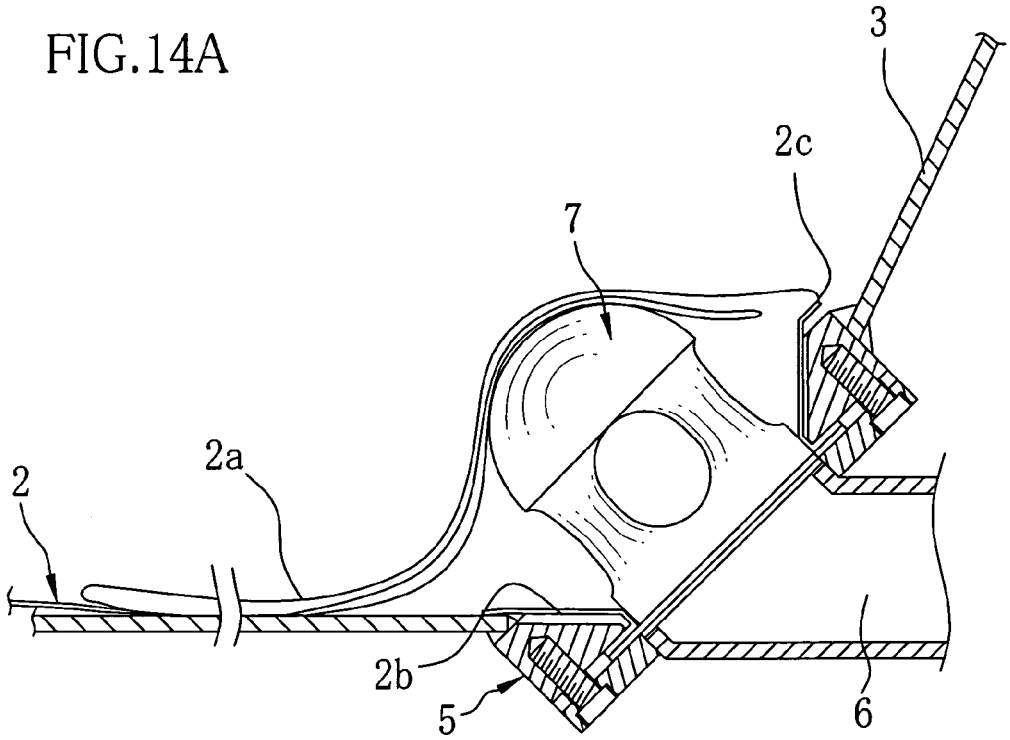
FIGS. 14A and 14B are schematic cross-sectional views showing an early stage that the liquid is started to be filled after bending the first end portion near the upper portion of the tank supply-discharge opening.
Figure 14B:
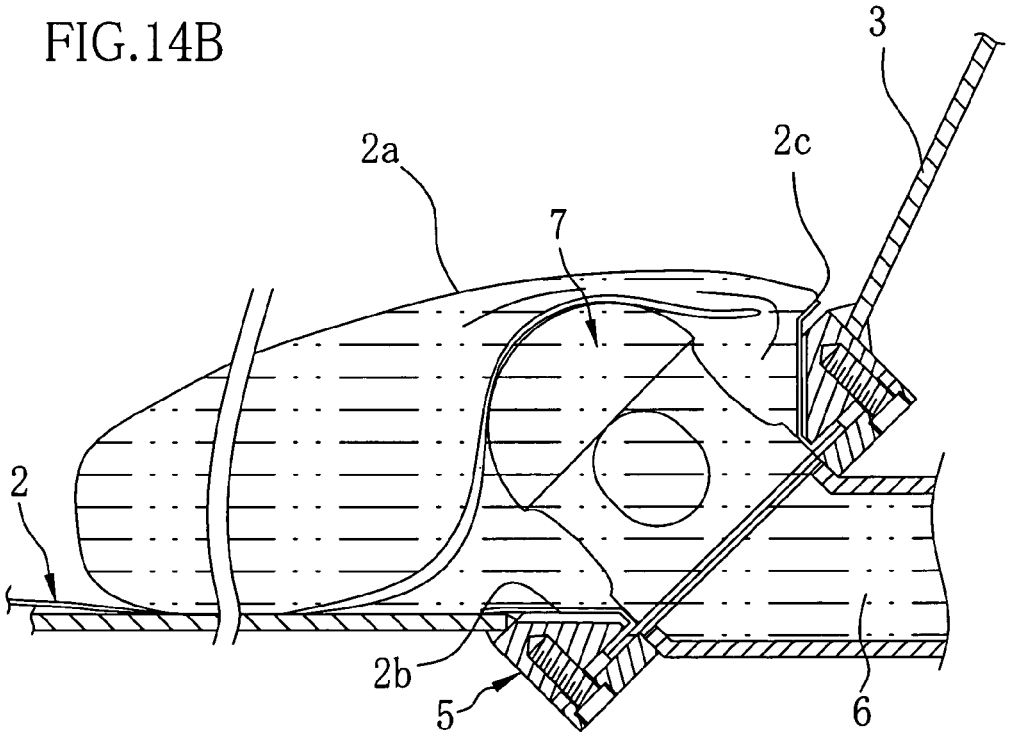

As shown in FIG. 12B, the liquid 6 as the cargo is filled from the tank supply-discharge opening 15. The filling speed is 50 liters per minute, for example. The inner bag body 21 is extended in the longitudinal direction in the tank body 11, so that the inner bag body 21 upswells by filling the liquid 6 in the inner bag body 21 smoothly. The both side edge portions of the inner bag body 21, which are folded inward, are gradually unfolded with the filling of the liquid, so that the end portions of the inner bag body 21 are not accidentally caught between the inner bag body 21 and the tank body 11 by the weight of the portion in which the liquid is filled. Therefore, the inner bag body 21 upswells smoothly by the filling of the liquid 6 to contain about 20 tons of liquid therein. In FIG. 12A, the first end portion 21*m* is bent to the tank supply-discharge opening side along the bending line 47 above the display mark 46. Accordingly, the liquid 6 does not enter the first end portion 21*m* as shown in FIG. 14B, but is filled toward the second end portion 21*n* as shown in FIG. 12B. Consequently, it is possible to eliminate the filling failure caused by filling the liquid 6 in the first end portion 21*m*. Instead of or in addition to providing the bending line 47, the filling speed in an early stage may be suppressed at, for example, 5 to 10 liters per minute, so that the second end portion 21*n* is preferentially filled with the liquid 6. The display mark 46 may be formed not in the inner bag body 21, but in the inner wall of the tank body 11.

In the present embodiment, the inner bag body 21 is loaded in the tank body 11 to extend in the longitudinal direction, and the side edge portions 21*p* and 21*q* are folded inward toward the central line extending in the width direction of the inner bag body 21. That prevents the air from entering the inner bag body 21 and the inner bag body 21 can be used for the anaerobic liquid. In addition, since the inner bag body 21 and the inner bag supply-discharge opening 22 are made from LLDPE having high chemical resistance, the tank body 11 has more choices in material. Furthermore, it is unnecessary to line the inner peripheral surface of the tank body 11 with fluorocarbon resin such as polytetrafluoroethylene.

When the inner bag body 21 dwindles to close with the inner bag supply-discharge opening 22 after the remaining amount of the liquid is reduced, the inner bag body 21 may be accidentally sucked into the inner bag supply-discharge opening 22 to cover the opening 22. In order to prevent the inner bag body 21 from covering the inner bag supply-discharge opening 22 in discharging the liquid from the tank supply-discharge opening 15, when the liquid is discharged from the tank supply-discharge opening 15, a passage between the inner bag body 21 and the inner bag supply-discharge opening 22 is ensured by the inner bag suction preventing member 30. The inner bag suction preventing member 30 is integrally constituted of a semi-spherical end 30*b* arranged to protrude toward the inside of the tank body 11, a tubular portion 30*d* whose peripheral surface has plural continuous holes 30*c*, and an attachment flange 30*a* provided on the base of the tubular portion 30*d*. The semi-spherical end 30*b* protrudes toward the inside of the inner bag body 21, so that the residual liquid in the inner bag body 21 can be surely discharged through the continuous holes 30*c* without the inner bag body 21 stick to the inner bag supply-discharge opening 22.

In addition to the inner bag supply-discharge opening 22, an air vent cap and an air vent valve (not shown) may be welded to the inner bag body 21 at a position corresponding to the tank hatch. In this case, if the air enters the inner bag body 21 by the operation of loading the inner bag body 21 or filling the liquid, the air can be vented easily.

In the above embodiment, the inner bag body 21 is made from LLDPE, it may be made from LDPE (low-density polyethylene), OP (biaxially oriented polypropylene) and other synthetic resin. In addition, although the inner bag body 21 is doubled in the present embodiment, it may be formed in a multilayer structure to have three or more layers. Furthermore, the inner bag 20 may be used not only for the tank container, but also for a tanker lorry and so forth.

Figure 13B:
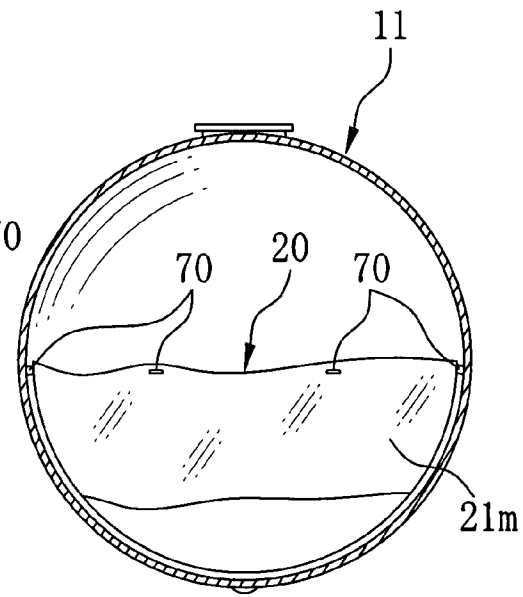
FIG. 13B is a transverse cross-sectional view showing a state where the inner bag is loaded in the tank body in another embodiment.
Figure 13A:
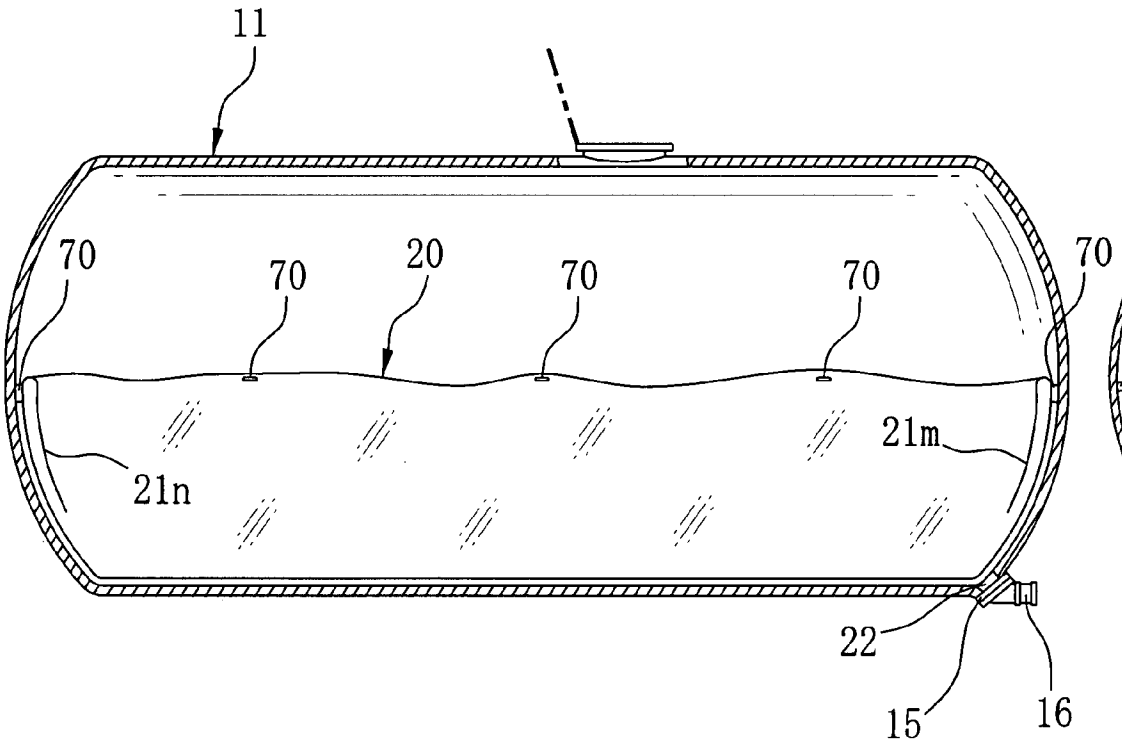
FIG. 13A is a longitudinal cross-sectional view showing a state where the inner bag is loaded in the tank body in another embodiment.

In FIGS. 13A and 13B, the inner bag body 21 is loaded in the tank body 11 with fixing the inner bag body 21 by a double-sided adhesive tape 70. The double-sided adhesive tape 70 is attached to a predetermined position when folding the inner bag body 21. One adhesive face of the double-sided adhesive tape 70 is attached after peeling a release paper thereon. Another adhesive face is attached to the inner surface of the tank body 11 after peeling a release paper thereon at the time of unfolding the inner bag body 21, so that the inner bag body 21 is fixed in the inner surface of the tank body 11 so as to be unfolded easily. The double-sided adhesive tape 70 needs only the adhesive force to temporally fix the inner bag body 21 to the inner surface of the tank body 11. When filling the liquid, the double-sided adhesive tape 70 is peeled from the inner surface of the tank body 11 in response to the swelling of the inner bag body 21, so that the swelling is not prevented.

Although the inner bag body 21 is fixed temporally to the inner surface of the tank body 11 by use of the double-sided adhesive tape 70 in FIGS. 13A and 13B, a magnet sheet may be attached to the tank body 11, instead of the double-sided adhesive tape 70, and stuck to the inner surface of the tank body 11 to temporally fix the inner bag body 21 thereto by the magnetic force.

The shape of the corner portions at both the sides of the inner bag body 21 is protruded compared to other portions, so that they are subject to rubbing against the inner surface of the tank body 11. In order to prevent the rubbing, after the corner portions at both the sides have been folded inward, the inner bag body 21 may be loaded in the tank body 11 with maintaining the folded state by use of a synthetic-resin clip, an adhesive tape, or the like.

The loading procedure may be numbered on the inner bag body 21 by using the sticker, the oil-based ink, and the like. For instance, each position to be unfolded in the tank body 11 is numbered in accordance with the order of unfolding, so that the inner bag body 21 can be surely loaded.

In the above embodiment, although the inner bag suction preventing member 30 is used, the present invention can be applied without the preventing member 30.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A loading method of an envelope type inner bag for a transport tank into said transport tank in a removable manner, said transport tank having a work hatch and a first supply-discharge opening, said inner bag having a second supply-discharge opening to be fitted to said first supply-discharge opening, said loading method comprising:

a folding step of folding an inner bag body of said inner bag, said inner bag body being folded inward or rolled toward said second supply-discharge opening from both ends of said inner bag body in parallel with a central line extending in a width direction of said inner bag body after both side edges of said inner bag body are folded inward an appropriate number of times in parallel with a central line extending in a longitudinal direction of said inner bag in a state that said second supply-discharge opening is directed downward;

an insertion step of inserting said folded inner bag into said transport tank from said work hatch;

a fitting step of inserting said second supply-discharge opening into said first supply-discharge opening in said transport tank to be fitted thereto; and an unfolding step of unfolding said inner bag body in the longitudinal direction in said transport tank.

2. A loading method as claimed in claim 1, further comprising a step of: forming a first mark in said inner bag body for conforming an orientation of said inner bag body to that of said transport tank;

wherein the orientation of said inner bag body is conformed to that of said transport tank in reference to said first mark in said fitting step.

3. A loading method as claimed in claim 2, further comprising: a bending step of bending a longitudinal end portion of said inner bag body adjacent to said second supply-discharge opening toward said second supply-discharge opening after said unfolding step, the bending position in said bending step being separated by at least 30 mm from an edge of said first supply-discharge opening.

4. A loading method as claimed in claim 3, further comprising a step of: forming a second mark for representing said bending position in said inner bag body or said transport tank, said end portion being bent in reference to said second mark.

5. A loading method as claimed in claim 4, wherein said inner bag body is attached temporally to an inner surface of said transport tank by a fixing member provided in said inner bag body or said transport tank.

6. A loading method as claimed in claim 4, wherein said second supply-discharge opening is provided on or adjacent thereto a central line extending in the longitudinal direction of said inner bag body, wherein length from one end of said inner bag body to said second supply-discharge opening is L1, length of said inner bag body is IL, width of said inner bag body is IW, an inner peripheral length of said transport tank in a longitudinal cross-sectional surface in the longitudinal direction is TLt, and the inner peripheral length of said transport tank in the longitudinal cross-sectional surface in a width direction is TLr, the following conditions are satisfied:

$0.47 \cdot TLt \leqq IL \leqq 0.6 \cdot TLt$, $0.47 \cdot TLr \leqq IW \leqq 0.6 \cdot TLr$, $0.44 \cdot IW \leqq L1 \leqq 0.5 \cdot IW$.

7. An inner bag for a transport tank to be loaded in said transport tank in a removable manner, said transport tank having a work hatch and a first supply-discharge opening, said inner bag comprising:

an envelope type inner bag body;

a second supply-discharge opening attached to said inner bag body to be fitted to said first supply-discharge opening; and a folding portion, formed in said inner bag body, being constituted of a first inward folding line and either a second inward folding line which is formed in a direction crosswise to said first inward folding line or a rolling-up portion, an appropriate number of said first inward folding line being formed in parallel with a central line extending in a longitudinal direction of said inner bag body in a state that said second supply-discharge opening is directed downward, an appropriate number of said second inward folding line being formed in parallel with a central line extending in a width direction of said inner bag body from both ends of said inner bag body toward said second supply-discharge opening in a state that both the side edges are folded inward along said first inward folding line, said rolling-up portion being formed by rolling up said inner bag body from both the ends of said inner bag body toward said second supply-discharge opening in a state that both the side edges are folded inward along said first inward folding line.

8. An inner bag as claimed in claim 7, wherein said inner bag body includes a first mark, said first mark conforms an orientation of said inner bag body to that of said transport tank when said inner bag body is loaded in said transport tank.

9. An inner bag as claimed in claim 8, wherein said inner bag body includes a second mark, said second mark shows a position to bend a longitudinal end portion of said inner bag body adjacent to said second supply-discharge opening toward said second supply-discharge opening after inserting said inner bag body into said transport tank.

10. An inner bag as claimed in claim 9, wherein said inner bag body includes a fixing member for temporally attaching said inner bag body to an inner surface of said transport tank.

11. An inner bag as claimed in claim 8, wherein said second supply-discharge opening is provided on or adjacent to a central line extending in the longitudinal direction of said inner bag body, wherein length from one end of said inner bag body to said second supply-discharge opening is L1, length of said inner bag body is IL, width of said inner bag body is IW, an inner peripheral length of said transport tank in a longitudinal cross-sectional surface in the longitudinal direction is TLt, and the inner peripheral length of said transport tank in the longitudinal cross-sectional surface in a width direction is TLr, the following conditions are satisfied:

$0.47 \cdot TLt \leqq IL \leqq 0.6 \cdot TLt$, $0.47 \cdot TLr \leqq IW \leqq 0.6 \cdot TLr$, $0.44 \cdot IW \leqq L1 \leqq 0.5 \cdot IW$.

* * * * *